United States Patent [19]

Beelmann et al.

[11] Patent Number: 4,545,727

[45] Date of Patent: Oct. 8, 1985

[54] MILL WITH BLOWER IMPELLER

[75] Inventors: Richard Beelmann, Mülheim; Johannes Kerstges, Oberhausen, both of Fed. Rep. of Germany

[73] Assignee: Deutsche Babcock Werke Aktiengesellschaft, Oberhausen, Fed. Rep. of Germany

[21] Appl. No.: 435,091

[22] Filed: Oct. 18, 1982

[30] Foreign Application Priority Data

Oct. 23, 1981 [DE] Fed. Rep. of Germany ..... 3142042

[51] Int. Cl.[4] ..... B02C 13/10

[52] U.S. Cl. ..... 415/206; 416/203; 241/56

[58] Field of Search ..... 415/121 B, 143, 206; 416/203, 224; 366/265, 279, 317, 329; 241/56, 186.2

[56] References Cited

U.S. PATENT DOCUMENTS 3,946,952 3/1976 Martin ..... 241/56
4,161,293 7/1979 Beelmann et al. ..... 241/56
4,240,590 12/1980 Lautenschlager et al. ..... 241/56

FOREIGN PATENT DOCUMENTS 203339 10/1958 Austria ..... 241/56
1022541 3/1966 United Kingdom ..... 241/56

*Primary Examiner*—Robert E. Garrett
*Assistant Examiner*—Joseph M. Pitko
*Attorney, Agent, or Firm*—Max Fogiel

[57] ABSTRACT

A mill with an impeller in which blades are mounted between two disks, and each blade has a leading edge projecting into the cross-section of the inlet. The leading edge of every other one of the blades is perpendicular to the axis of the impeller, and the leading edge of the remaining blades on the impeller are skewed. The blades on the impeller alternate in sequence along the circumference of the impeller so that each blade with leading edge perpendicular to the impeller axis is adjacently neighbored on each side with blades having skewed leading edges. The alternative sequence of the blades reduce wear on the blades by a predetermined amount for increasing the operating life of the blades.

1 Claim, 2 Drawing Figures

MILL WITH BLOWER IMPELLER

BACKGROUND OF THE INVENTION

The present invention relates to a mill with an impeller, an axial inlet, and a radial outlet and with blades mounted between two disks with the leading edge of each blade projecting into the cross-section of the inlet.

Mills of this type are frequently employed as impeller or impeller-pug mills to mill dry soft coal. The leading edge of the blades in a known mill of this type are perpendicular to the axis of the impeller. The particles of coal that are entrained along with the airflow produced by the impeller in a mill of this type wear down the blades and the peripheral protective cladding on the impeller housing. Wear is especially severe on the surface of the blades that face the inlet and on the peripheral cladding. Such unilateral wear leads to premature breakdown of the blades and cladding.

Skewing the leading edge of the blades to make the wear somewhat more uniform is known in the art.

The object of the present invention is to provide an improvement in a mill of the same type but in which the wear on the blades and cladding is even more uniform.

SUMMARY OF THE INVENTION

The present invention achieves this object by providing that the leading edge of some of the blades is perpendicular to the axis of the impeller while that of the others is skewed. Preferably, every other blade along the circumference of the impeller has a skewed leading edge.

A design with blades that have different structures allows the flow of the mixture dust and air to be varied, resulting in uniform wear.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
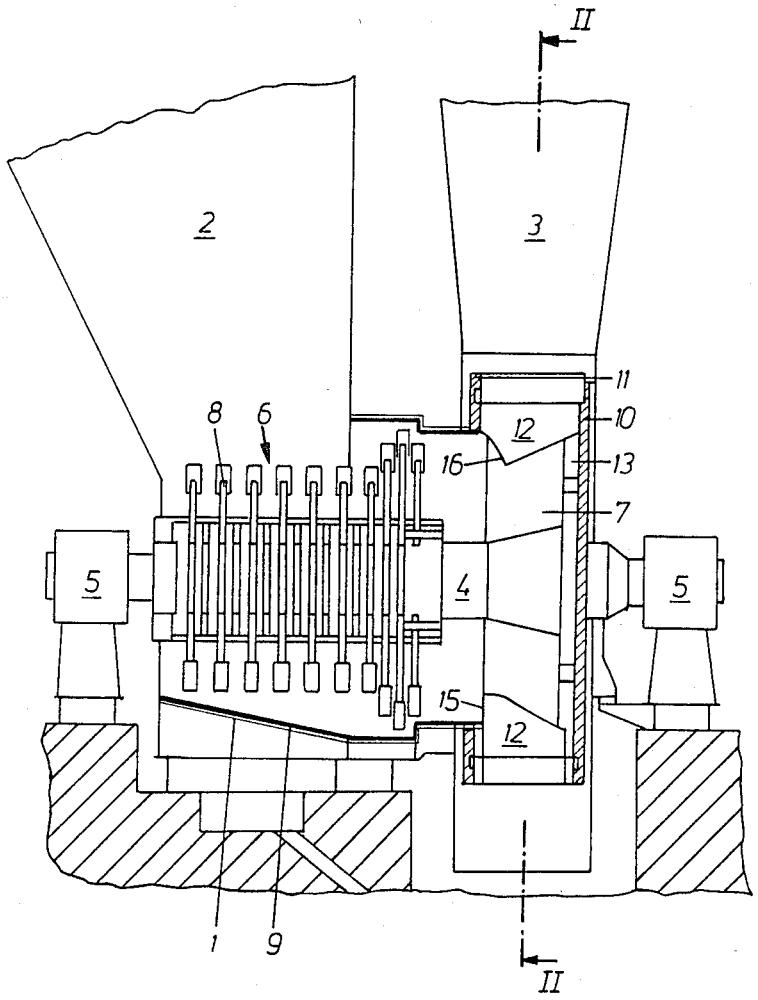
FIG. 1 is a longitudinal section through a mill in accordance with the present invention.
Figure 2:
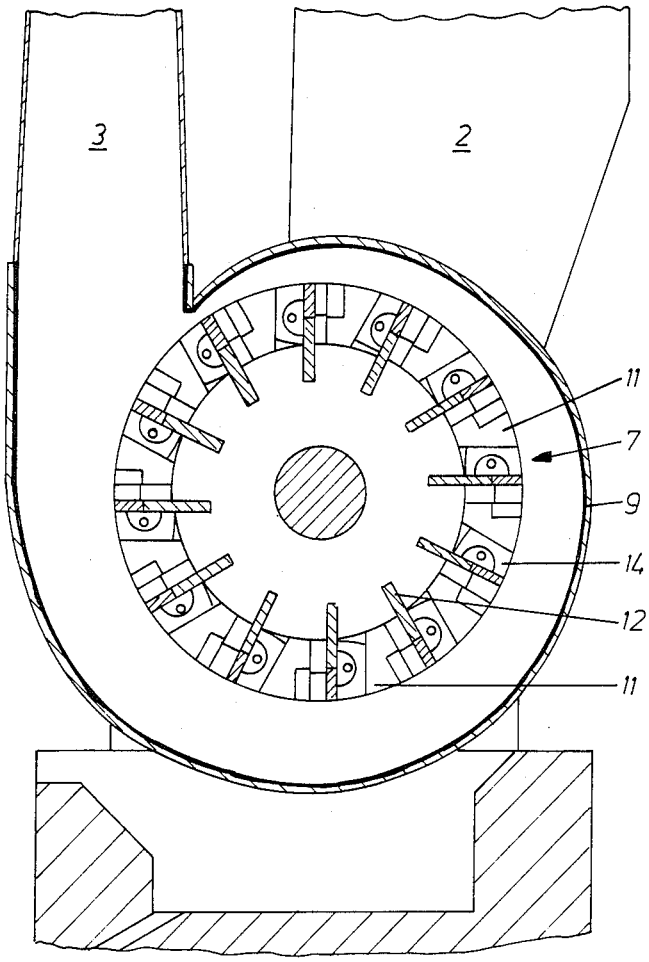
FIG. 2 is a larger-scale section taken along the line II—II in FIG. 1.

Although the drawings illustrate an impeller-pug mill, the present invention can also be embodied in an impeller mill.

The embodiment illustrated in the drawings has a housing 1 connected to an infeed 2 and an out-take 3. A motorized shaft 4 rotates inside housing 1 on two bearings 5 outside the housing. Shaft 4 carries a pugging component 6 and an impeller 7. Pugging component 8 contains several rows of puggers 8. Housing 1 is reinforced with cladding 9 in the vicinity of pugging component 8 and impeller 7.

Impeller 7 consists of two interconnected disks 10 and 11 with blades 12 mounted between them. Rear disk 10 is attached to shaft 4 and protected by an upstream bounce plate 13. Front disk 11 is annular and its opening lies on a line projected out from pugging component 6 and forms the axial inlet of impeller 7. Blades 12 are wear-resistant, essentially flat, plates that are attached to disks 10 and 11 with mounts 14. The leading edges 15 and 16 of blades 12 project into the inlet cross-section of impeller 7.

The material to be milled, unprocessed soft coal for example, is fed into the mill from a chute connected to the infeed 2 of housing 1. The material is broken up upstream of pugging component 6. Impeller 7 simultaneously suctions, through the chute for example, hot drying gas from the combustion chamber of an associated boiler. The gas dries the material while it is being broken up. The mixture of milled material and gas now emerges from impeller 7 with the material still being broken up even further and leaves the system through the radial outlet.

The eroding action of the mixture of material and gas wears down blades 12 and cladding 9. Blades 12 are specially designed to make this wear uniform. The leading edge 15 of some of the blades is perpendicular to the axis of the impeller while that 16 of the others is skewed. The design will be more practical if blades with a leading edge 15 that is perpendicular to the axis alternate along the circumference of the impeller with those that have a leading edge 16 that is skewed.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A mill comprising: an impeller; an axial inlet with a cross-section, and a radial outlet; blades mounted between two disks, each blade having a leading edge projecting into the cross-section of said inlet; the leading edge of every other one of said blades being perpendicular to the axis of the impeller and the leading edge of the remaining blades on said impeller being skewed; said blades on said impeller alternating in sequence along the circumference of said impeller so that each blade with leading edge perpendicular to the impeller axis is adjacently neighbored on each side with blades having skewed leading edges; the alternating sequence of said blades reducing wear on said blades by a predetermined amount for increasing the operating life of the blades; a casing surrounding said impeller; said sequence of blades also distributing dust material substantially uniformly onto said casing for uniform wear of said casing.

* * * * *